US006854952B2

(12) United States Patent
Ebner et al.

(10) Patent No.: US 6,854,952 B2
(45) Date of Patent: Feb. 15, 2005

(54) DEVICE FOR EXTENDING OR SHORTENING A NETWORK OF PIPES

(75) Inventors: Bernhard Ebner, Knittelfeld (AT); Bruno Reumüller, Knittelfeld (AT); Barry Schmitke, Saskatoon (CA)

(73) Assignees: Voest-Alpine Bergtechnik Gesellschaft m.b.H., Zeltweg (AT); Cigar Lake Mining Corporation, Saskatoon (CA)

( * ) Notice: Subject to any disclaimer, the term of this patent is extended or adjusted under 35 U.S.C. 154(b) by 22 days.

(21) Appl. No.: 10/276,276

(22) PCT Filed: May 15, 2001

(86) PCT No.: PCT/AT01/00145

§ 371 (c)(1),
(2), (4) Date: Apr. 7, 2003

(87) PCT Pub. No.: WO01/88325

PCT Pub. Date: Nov. 22, 2001

(65) Prior Publication Data

US 2003/0147735 A1 Aug. 7, 2003

(30) Foreign Application Priority Data

May 17, 2000 (AT) ..... A 863/2000

(51) Int. Cl.[7] ..... E21B 19/15

(52) U.S. Cl. ..... 414/745.4; 414/745.5; 414/22.51; 414/22.59; 414/745.7

(58) Field of Search ..... 414/745.4, 745.5, 414/745.7, 22.51, 22.53, 22.59, 22.61, 22.62

(56) References Cited

U.S. PATENT DOCUMENTS 3,792,783 A * 2/1974 Brown ..... 414/22.62
3,913,753 A * 10/1975 Swartz et al. ..... 414/22.66
3,916,500 A * 11/1975 Brown ..... 29/240
4,202,653 A * 5/1980 Moller ..... 414/22.57
4,362,435 A * 12/1982 Henry ..... 405/184.5
4,426,182 A * 1/1984 Frias et al. ..... 414/22.61
4,438,902 A * 3/1984 Latimer ..... 254/106
4,439,091 A * 3/1984 Frias ..... 414/22.59
4,445,579 A * 5/1984 Bello ..... 175/52
4,684,314 A * 8/1987 Luth ..... 414/746.1
5,122,023 A * 6/1992 Mochizuki ..... 414/22.61
5,423,390 A * 6/1995 Donnally et al. ..... 175/85
5,886,314 A * 3/1999 Sims ..... 291/121.44
5,931,238 A * 8/1999 Gilmore et al. ..... 175/52
5,941,324 A * 8/1999 Bennett ..... 175/85
6,533,519 B1 * 3/2003 Tolmon et al. ..... 414/22.54
6,543,551 B1 * 4/2003 Sparks et al. ..... 175/52

* cited by examiner

*Primary Examiner*—Douglas Hess
(74) *Attorney, Agent, or Firm*—Chapman and Cutler LLP

(57) ABSTRACT

In a device for extending and shortening tubings used to transport drill cuttings and stripped material, a tube storage or tube magazine is provided on a frame (1) capable of being supported on the floor, wherein at least one lifting means (3) capable of being displaced in the height direction and intended to lift tubes (17) into a storage position as well as at least one manipulator (13) intended to position a tube removed from the tube storage into a position in alignment with a laid tube track are arranged on the frame (1). The frame includes at least one longitudinal guide (5) for a telescoping tube (7) that is capable of being integrated in the tube track.

30 Claims, 4 Drawing Sheets

DEVICE FOR EXTENDING OR SHORTENING A NETWORK OF PIPES

The invention relates to a device for extending and shortening tubings used to transport drill cuttings and stripped material.

Various methods have become known for the underground winning of minerals. A method of this type, which is described in U.S. Pat. No. 5,380,127, proposes to separate the material to be won by the aid of high-pressure fluid jets, whereupon the material dissolved in the fluid is conducted away via tubings. Such a "jet boring system" is used, for instance, in ore deposits which occur below lakes and contain, for instance, uranium ores. In those cases a tunnel tube is driven to enable excavation, whereupon, after having provided appropriate bores and linings, a jet boring excavation tool is introduced into the guiding tubes or lining tubes, whereupon the mineral is extracted by the aid of high-pressure water and carried off into the tube network. Particularly during the winning of highly radioactive uranium ores and with high pressures applied for the extraction of such ores, accordingly pressure-proof tubings are required. If the material comprises radioactively radiating material, tubes having relatively high wall thicknesses must, moreover, be used in order to provide a shield against the radiation of the hauled material. It is impossible, particularly in such ore deposits and with such winning methods, to use flexible tubes within the duct system, and, therefore, it is necessary with such a winning method to constantly adapt the haulage duct to the changing site positions of the excavation tool.

The invention aims to provide a device of the initially defined kind, which enables the mechanized assembly and disassembly of tubes in order to enable thick-walled and heavy and appropriately shielded tubes to be each guided precisely to the required position, wherein mechanization to the largest extent possible is to enable the rapid extension or shortening of the tube system. To solve this object, the device according to the invention essentially consists in that a tube storage or tube magazine is provided on a frame capable of being supported on the floor, that at least one lifting means capable of being displaced in the height direction and intended to lift tubes into a storage position as well as at least one manipulator intended to position a tube removed from the tube storage into a position in alignment with a laid tube track are arranged on the frame, and that the frame comprises at least one longitudinal guide for a telescoping tube that is capable of being integrated in the tube track. The tube storage or tube magazine enables an appropriate number of tubes to be introduced into the tunnel and an accordingly large stock of tubes to be provided on as small a space as possible at relatively small tunnel tube dimensions. The lifting means, which can be displaced on the frame in the height direction, enables tubes to be moved into a storage position and fed on the upper side of the storage or removed on the lower side of the storage. In order to move such a tube upon removal from the storage into the correct mounting position, at least one manipulator is provided according to the invention, which is fixed to the frame of the tube storage and enables a tube taken from the tube storage to be placed in a position in alignment with a laid tube track. Since such thick-walled and relatively heavy tubes as are required in the context of the initially described excavation method have certain lengths, it is necessary in each case to bridge the respective distance that enables the installation of a further tube or the removal of a tube. Since, as mentioned in the beginning, flexible tubes cannot be employed on account of the high pressures applied and the peculiarities of the mineral to be hauled, it is proposed according to the invention that the frame comprises at least one longitudinal guide for a telescoping tube that is capable of being integrated in the tube track so as to bridge the respective distance between two consecutive installation positions of the device in an accordingly pressure-proof and radiation-shielded manner by means of such a telescoping tube capable of being integrated in the tube track.

In an advantageous manner, the configuration according to the invention is devised such that the tube storage comprises a plurality of rails, sliding or rolling surfaces extending in a manner inclined relative to the plane of the floor, which extend so as to be alternately inclined downwardly relative to a plane extending parallel with the plane of the floor, that a downwardly extending rail or surface each terminates above a downwardly extending rail or surface arranged therebelow, at a distance from the lateral delimitation of the tube storage, which distance is larger than the diameter of a tube, and that an ejection means is connected to the lowermost downwardly extending rail or surface for the separation and delivery of a tube into a removal position outside the tube storage and substantially parallel with the original position. Such a tube storage enables a plurality of tubes to be arranged in a mutually cascading manner in the height direction and transverse to the storage, whereby the sliding or rolling surfaces enable the tubes in the storage box to automatically roll off into the respective removal position. On their way from the feeding position into the removal position, the tube axes are guided in a serpentine-like manner, viewed in the longitudinal direction of the tube, and hence always arrive on downwardly inclined surfaces, thus automatically reaching the removal position. On the lower end, a simple separation means is provided for the ejection of a tube into a position from which the appropriate manipulation of the tube is rendered feasible in a fully mechanized mode of operation. In this respect, the configuration advantageously is devised such that the tubes, in the removal position, rest on the lifting means capable of being displaced in the height direction.

In addition to such a lifting means, which naturally could also assume the basic function of a manipulator at an accordingly pivotable configuration of the lifting means, the configuration advantageously is devised such that the manipulator(s) intended to position the removed tube comprise(s) gutter- or claw-shaped supporting elements for the tubes, which elements are extractable in the height direction and transverse to the height direction by hydraulic or pneumatic cylinder-piston units. The tube extracted from the storage in this manner can be moved obliquely upwards into a position in which the appropriate connection and integration into the existing tube track is feasible immediately and likewise in a mechanized manner. In order to enable the precise adjustment of the positioning means or manipulator, the configuration advantageously is devised such that the hydraulic or pneumatic cylinder-piston units are pivotable and connected with the frame of the tube storage so as to be fixable in their pivoted position.

The respective tube which is each telescoping to bridge a predetermined length advantageously can also be suspended from the device, to which end the configuration advantageously is devised such that the longitudinal guide for the telescoping tube is comprised of at least one sliding or rolling rail which cooperates with at least one sliding or rolling element connected with the telescoping tube. The frame used for the tube storage must exhibit an appropriate stability on account of the weight of the plurality of tubes and is well apt to take up the forces acting on such guides, lifting elements or manipulator.

In order to displace the device in the respectively appropriate position for the installation of a tube, the configuration advantageously is devised such that the frame comprises at least one guide roller and supports capable of being lowered below the running surfaces of the guide rollers, which supports can be extended during manipulation and, thus, substantially facilitate the mechanized approach of a precise mounting position. In procedural terms, the device according to the invention can be further developed in a manner that the frame is coupleable to, or connected with, a moving mechanism, in particular a crawler mechanism.

A particularly simple means for the ejection of a tube and separation of a tube is feasible in that the ejection means is comprised of a pivotable stirrup which is substantially C-shaped in cross section and whose clear width is selected to be smaller than, or equal to, the diameter of a tube deposited in the storage.

In the following, the invention will be explained in more detail by way of an exemplary embodiment schematically illustrated in the drawing. Therein, FIG. 1 is a side view of the device according to the invention;

FIG. 4 illustrates a detail of the view according to

Figure 3:
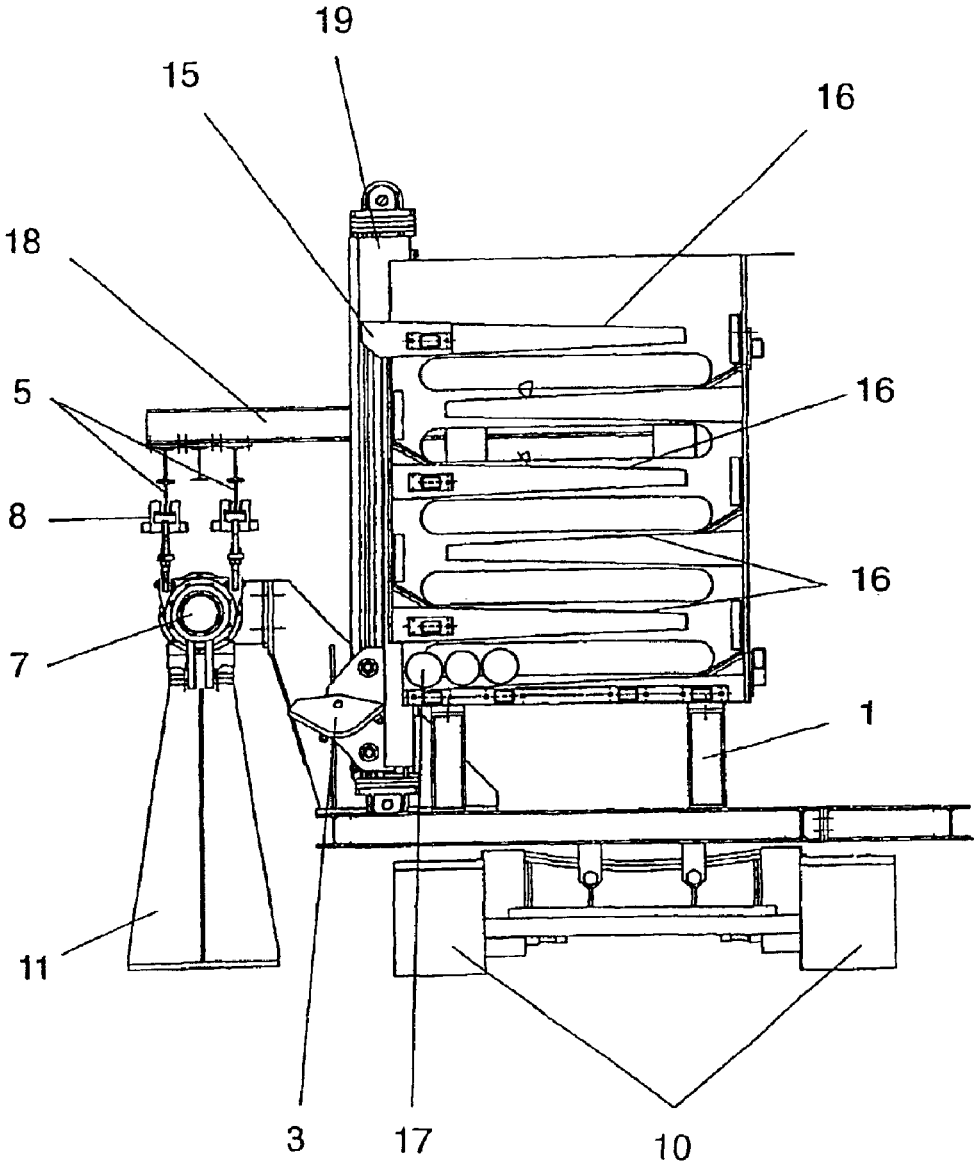
FIG. 3 is a view of the device according to the invention in the longitudinal direction of a tube track.
Figure 5:
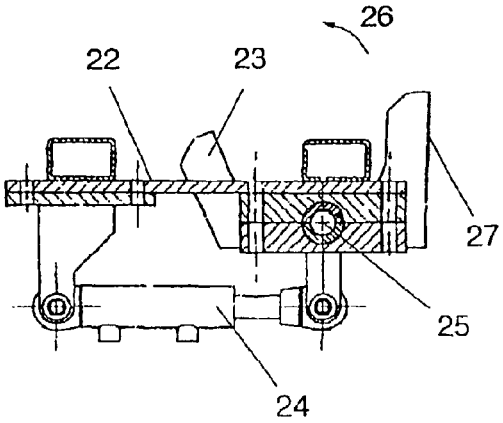

FIG. 3 including the manipulater provided to position the tubes;

FIG. 5 illustrates a detail of the ejection and separation means; and

Figure 6:
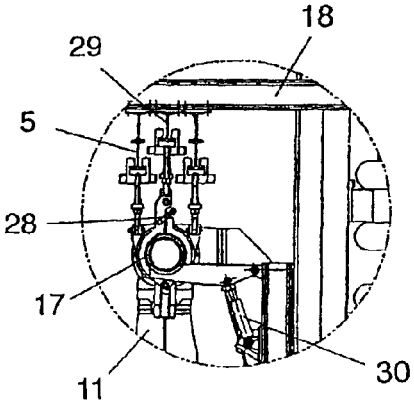

FIG. 6 illustrates a detail of the suspension means of the tube track and the telescoping tube within the tunnel.

Figure 1:
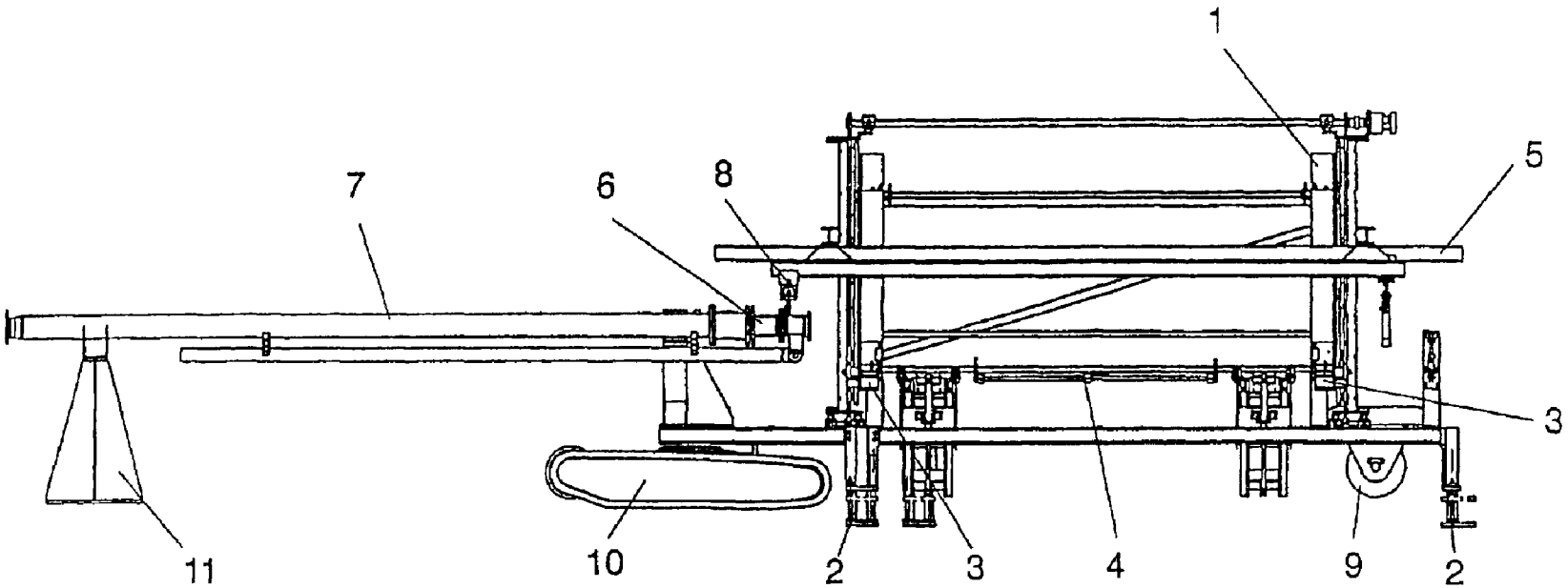

In FIG. 1, the frame of the device according to the invention is denoted by 1. Telescopically extensible supports 2 are fixed on the frame, a lifting means denoted by 3 being arranged on a vertical spar so as to be displaceable in the height direction. The ejection means is schematically indicated by 4 in FIG. 1, its details being illustrated in more detail in FIG. 5.

The frame 1, furthermore, carries a longitudinal rail 5, from which the end 6 of a telescoping tube 7 is suspended. The end 6 of this telescoping tube 7 is suspended alongside of the rail 5 via rolling slide supports 8 such that a full tube length can be bridged on account of the telescopability of the tube.

FIG. 1, furthermore, depicts a running roller 9 of the frame 1 of the tube storage, which is designed as a guide roller. The frame 1 inter alia is coupled to a crawler mechanism 10 and capable of being displaced into the respective position using the guide rollers 9, upon retraction of the supports 2. A supporting trestle for the telescoping tube is denoted by 11.

Figure 2:
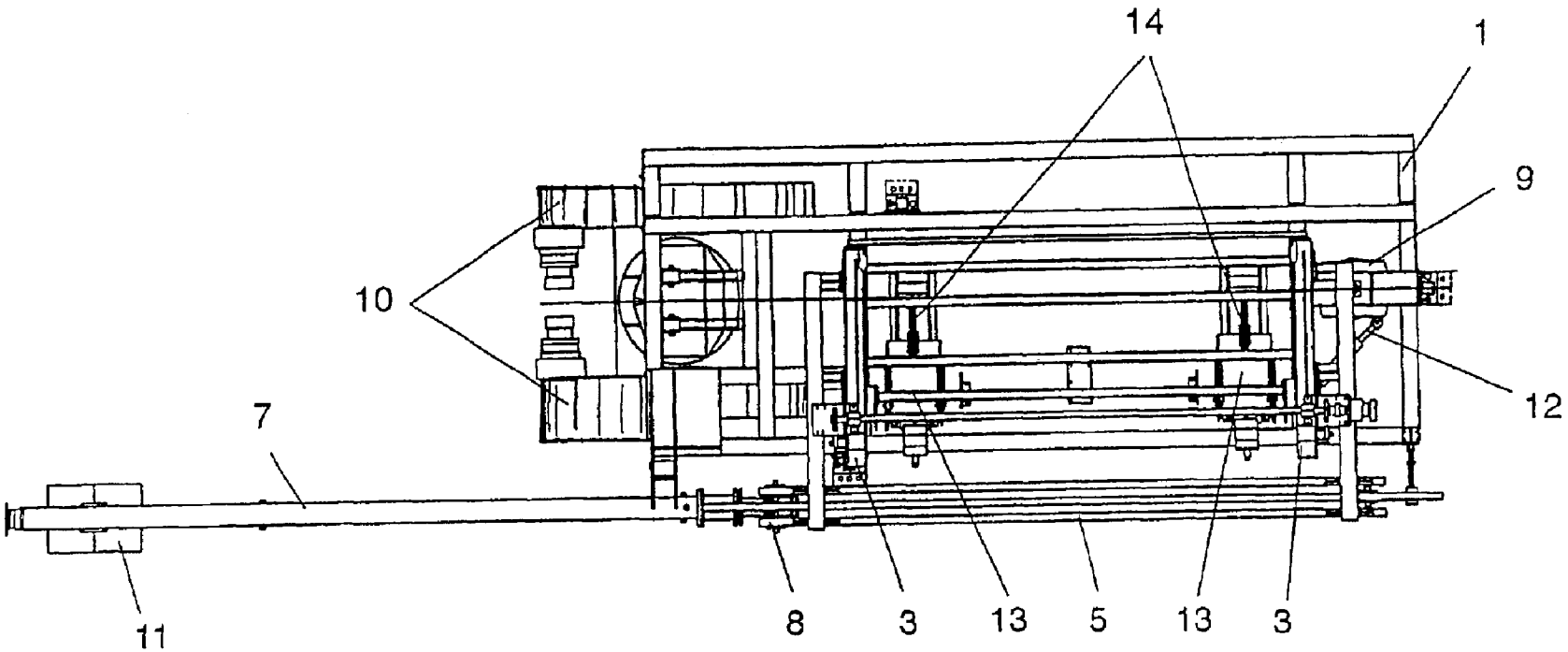
FIG. 2 is a top view on the device according to the invention.

From the top view according to FIG. 2, a hydraulic cylinder-piston unit 12 is apparent, which serves to appropriately control the guide rollers 9. In addition to the lifting means 3, manipulators 13 are provided, which can be displaced into their respective mounting positions by means of hydraulic cylinder-piston units 14.

From the illustration according to FIG. 3, the function of the lifting means 3 and the arrangement of the guide rails or slide planes for the tube storage are more clearly apparent. By the lifting means 3, tubes can be moved into a delivery position on the upper end of the frame of the storage and thrown off into a feeder chute 15. After this, the tubes, via slanted surfaces 16 which may be formed by simple sliding rails or rolling rails, move downwards in a meander-like manner until they reach a delivery position, such a tube in the delivery or removal position being indicated by 17. With the frame 1 is connected a carrier 18 to which the longitudinal guiding rails 5 for the telescoping tube 7 are fixed. The actuating means for the lifting means 3 is comprised of a motor 19.

Figure 4:
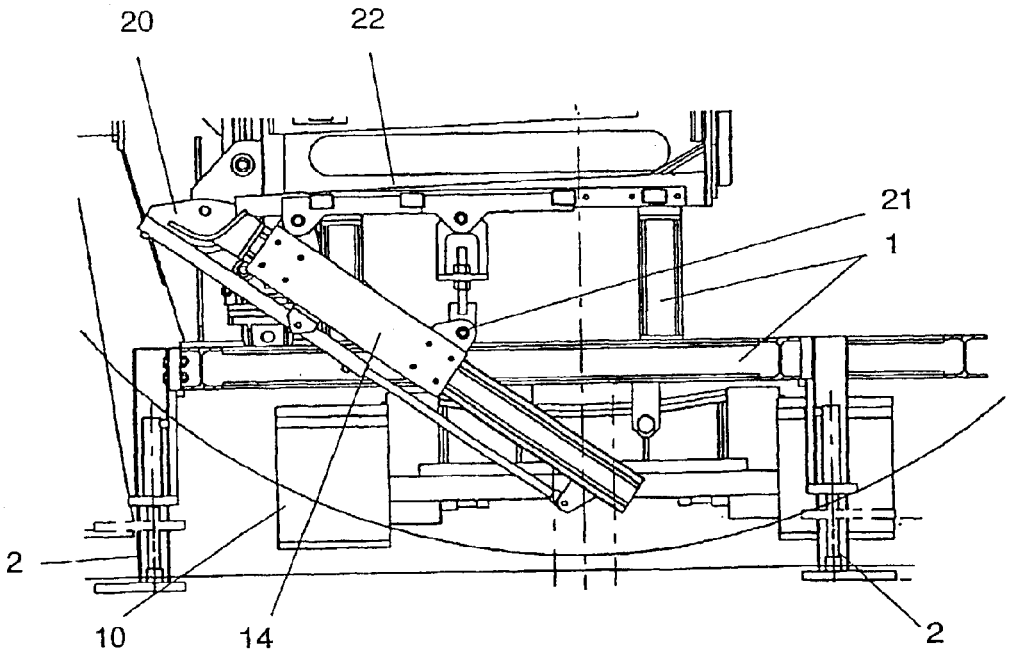

The means for the manipulation of a tube, which has already been indicated by 13 in FIG. 1, is illustrated on an enlarged scale in FIG. 4. The hydraulic cylinder-piston unit, which is again denoted by 14, serves to displace a claw-shaped support 20 for a tube to be manipulated, laterally and in the height direction transverse to the longitudinal direction of the tube. The hydraulic cylinder-piston unit is pivotable about an axis 21 so as to enable precise positioning, and can be fixed in the respectively pivoted position. By actuating the hydraulic cylinder piston unit 14, a tube taken from the storage is brought into a position in alignment with the tube track laid in the road and there can be readily coupled and tightly connected. The lowermost slanted plane of the tube storage is denoted by 22 and comprises an ejection means via which tubes can be discharged separately to the pick-up support 20. As is apparent, in particular, from FIG. 5, the separation means is comprised of a substantially C-shaped stirrup 23 which can be pivoted about an axis 25 by means of a hydraulic cylinder-piston unit 24. Such a device will always pick up a single tube, because the clear width of the substantially C-shaped section corresponds essentially to the diameter of a tube, or is smaller than the same, such that one tube is each moved into the delivery position by a pivotal movement in the sense of arrow 26 and a tube following on the slanted plane is impeded from moving further by a leg 27 of the stirrup.

From FIG. 6, the mounting position of the tube is apparent in detail. The telescopic tube is again suspended from the rails 5, whereby a tube 17 is brought into the mounting position by the manipulator. In this mounting position, the tube is seized by a tension coupling 28 and suspended on another rail 29 provided within the tunnel, and hence integrated in the continuous tube track, whereupon the free end of the tube 17 is again connected with the telescoping end 6 of the telescoping tube 7. Here, a hydraulic cylinder-piston unit 30 including a manipulator 31 is provided for the precise positioning and orientation.

What is claimed is:

1. A device for extending and shortening tubings used to transport drill cuttings and stripped material, comprising tube storage provided on a frame (1) capable of being supported on a floor, at least one means for lifting (3) arranged on said frame (1), capable of being displaced in the height direction, to lift tubes (17) into a storage position;

at least one manipulator (13) arranged on said frame (1), to position a tube (17) removed from said tube storage into a position in alignment with a laid tube track;

wherein the frame (1) comprises at least one longitudinal guide (5) for a telescoping tube (7) that is capable of being integrated in the tube track.

2. A device according to claim 1, wherein said tube storage comprises a plurality of slanted surfaces (16) extending in a manner inclined relative to a plane parallel with the plane of the floor, which slanted surfaces (16) extend so as to be alternately inclined relative to a plane parallel with the plane of the floor, such slanted surfaces (16) each terminating above a slanted surface (16) arranged therebelow, at a distance from a lateral delimitation of the tube storage, which distance is larger than a diameter of a tube (17); and a means for ejection of tubes (17) is connected to a lowermost slanted surface (22) for the separation and delivery of a tube (17) into a removal position outside the tube storage and substantially parallel with the original position.

3. A device according to claim 2, wherein the tubes (17) in the removal position rest on the at least one means for lifting (3).

4. A device according to claim 3, wherein the at least one manipulator (13) comprises supporting elements (20) for the tubes (17), wherein said supporting elements (20) are extractable in the height direction and transverse to the height direction by cylinder-piston units (14).

5. A device according to claim 4, wherein the cylinder-piston units (14) are pivotable and connected with the frame (I) of the tube storage so as to be fixable in their pivoted positions.

6. A device according to claim 5, wherein the at least one longitudinal guide (5) for the telescoping tube (7) is comprised of at least one rail adapted to movably connect to at least one sliding or rolling element (8), which is connected to the telescoping tube (7).

7. A device according to claim 4, wherein the at least one longitudinal guide (5) for the telescoping tube (7) is comprised of at least one rail adapted to movably connect to at least one sliding or rolling element (8), which is connected to the telescoping tube (7).

8. A device according to claim 3, wherein the at least one longitudinal guide (5) for the telescoping tube (7) is comprised of at least one rail adapted to movably connect to at least one sliding or rolling element (8), which is connected to the telescoping tube (7).

9. A device according to claim 2, wherein the at least one manipulator (13) comprises supporting elements (20) for the tubes (17), wherein said supporting elements (20) are extractable in the height direction and transverse to the height direction by cylinder-piston units (14).

10. A device according to claim 9, wherein the cylinder-piston units (14) are pivotable and connected with the frame (1) of the tube storage so as to be fixable in their pivoted positions.

11. A device according to claim 10, wherein the at least one longitudinal guide (5) for the telescoping tube (7) is comprised of at least one rail adapted to movably connect to at least one sliding or rolling element (8), which is connected to the telescoping tube (7).

12. A device according to claim 9, wherein the at least one longitudinal guide (5) for the telescoping tube (7) is comprised of at least one rail adapted to movably connect to at least one sliding or rolling element (8), which is connected to the telescoping tube (7).

13. A device according to claim 2, wherein the at least one longitudinal guide (5) for the telescoping tube (7) is comprised of at least one rail adapted to movably connect to at least one sliding or rolling element (8), which is connected to the telescoping tube (7).

14. A device according to claim 2, wherein the frame (1) comprises at least one guide roller (9) having running surfaces, and supports (2) capable of being lowered below the running surfaces of at least one guide roller (9).

15. A device according to claim 2, wherein the frame (1) is adapted to be connected to a means for moving (10) said device.

16. A device according to claim 2, wherein the means for ejection is comprised of a pivotable stirrup (23) which is substantially C-shaped in cross section and whose clear width is smaller than, or equal to, the diameter of a tube (17) deposited in the tube storage.

17. A device according to claim 1, wherein the at least one manipulator (13) comprises supporting elements (20) for the tubes (17), wherein said supporting elements (20) are extractable in the height direction and transverse to the height direction by cylinder-piston units (14).

18. A device according to claim 17, wherein the cylinder-piston units (14) are pivotable and connected with the frame (1) of the tube storage so as to be fixable in their pivoted positions.

19. A device according to claim 18, wherein the at least one longitudinal guide (5) for the telescoping tube (7) is comprised of at least one rail adapted to movably connect to at least one sliding or wiling element (8) which is connected to the telescoping tube (7).

20. A device according to claim 18, wherein the frame (1) comprises at least one guide roller (9) having running surfaces, and supports (2) capable of being lowered below the running surfaces of at least one guide roller (9).

21. A device according to claim 18, wherein the frame (1) is adapted to be connected to a means for moving (10) said device.

22. A device according to claim 17, wherein the at least one longitudinal guide (5) for the telescoping tube (7) is comprised of at least one rail adapted to movably connect to at least one sliding or rolling element (8), which is connected to the telescoping tube (7).

23. A device according to claim 17, wherein the frame (1) comprises at least one guide roller (9) having running surfaces, and supports (2) capable of being lowered below the running surfaces of at least one guide roller (9).

24. A device according to claim 17, wherein the frame (1) is adapted to be connected to a means for moving (10) said device.

25. A device according to claim 1, wherein the at least one longitudinal guide (5) for the telescoping tube (7) is comprised of at least one rail adapted to movably connect to at least one sliding or rolling element (8), which is connected to the telescoping tube (7).

26. A device according to claim 25, wherein the frame (1) comprises at least one guide roller (9) having running surfaces, and supports (2) capable of being lowered below the running surfaces of at least one guide roller (9).

27. A device according to claim 25, wherein the frame (1) is adapted to be connected to a means for moving (10) said device.

28. A device according to claim 1, wherein the frame (1) comprises at least one guide roller (9) having running surfaces, and supports (2) capable of being lowered below the running surfaces of at least one guide roller (9).

29. A device according to claim 28, wherein the frame (1) is adapted to be connected to a means for moving (10) said device.

30. A device according to claim 1, wherein the frame (1) is adapted to be connected to a means for moving (10) said device.

* * * * *